US010773131B2

(12) United States Patent
Sato et al.

(10) Patent No.: US 10,773,131 B2
(45) **Date of Patent: *Sep. 15, 2020**

(54) MULTI-PIECE SOLID GOLF BALL

(71) Applicant: Bridgestone Sports Co., Ltd., Minato-ku, Tokyo (JP)

(72) Inventors: Katsunori Sato, Chichibushi (JP); Hideo Watanabe, Chichibushi (JP)

(73) Assignee: Bridgestone Sports Co., Ltd., Minato-ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/360,176

(22) Filed: Mar. 21, 2019

(65) Prior Publication Data

US 2020/0086176 A1 Mar. 19, 2020

Related U.S. Application Data

(63) Continuation-in-part of application No. 15/934,172, filed on Mar. 23, 2018, now Pat. No. 10,293,217.

(30) Foreign Application Priority Data

May 25, 2017 (JP) ..... 2017-103700

(51) Int. Cl.
*A63B 37/06* (2006.01)
*A63B 37/00* (2006.01)

(52) U.S. Cl.
CPC ..... *A63B 37/0076* (2013.01); *A63B 37/0006* (2013.01); *A63B 37/0007* (2013.01); *A63B 37/009* (2013.01); *A63B 37/0062* (2013.01); *A63B 37/0068* (2013.01); *A63B 37/0087* (2013.01); *A63B 37/0096* (2013.01); *A63B 2037/0079* (2013.01)

(58) Field of Classification Search
CPC ..... A63B 37/0068
USPC ..... 473/376
See application file for complete search history.

(56) References Cited

U.S. PATENT DOCUMENTS

| | | | |
|---|---|---|---|
| 7,367,901 | B2 | 5/2008 | Watanabe et al. |
| 8,597,140 | B2 | 12/2013 | Komatsu et al. |
| 8,690,712 | B2 | 4/2014 | Comeau et al. |

(Continued)

FOREIGN PATENT DOCUMENTS

| | | | |
|---|---|---|---|
| JP | 2006-230661 | A | 9/2006 |
| JP | 2006-289065 | A | 10/2006 |
| JP | 2011-115593 | A | 6/2011 |

*Primary Examiner* — Raeann Gorden
(74) *Attorney, Agent, or Firm* — Sughrue Mion, PLLC

(57) ABSTRACT

A multi-piece solid golf ball having a two-layer core with an inner core layer and an outer core layer and having a cover of at least two layers including an intermediate layer and an outer layer with numerous dimples on the surface is characterized in that the hardest cover layer has a specific material hardness and the ball has a specific value obtained by subtracting the surface hardness of the overall core from the surface hardness of the hardest cover layer, a specific deflection, and a specific value obtained by subtracting the initial velocity of the inner core layer from the initial velocity of the sphere consisting of the inner core layer encased by the outer core layer. This golf ball enables relatively low head speed golfers to achieve a good distance on full shots with drivers and iron clubs and also provides a soft, comfortable feel at impact.

15 Claims, 1 Drawing Sheet

(56) References Cited

U.S. PATENT DOCUMENTS

| | | | | |
|---|---|---|---|---|
| 10,293,217 | B2 * | 5/2019 | Sato | A63B 37/0009 |
| 2005/0164809 | A1 * | 7/2005 | Watanabe | A63B 37/0003<br>473/371 |
| 2009/0176601 | A1 * | 7/2009 | Snell | A63B 37/0003<br>473/376 |
| 2009/0209366 | A1 * | 8/2009 | Kasashima | A63B 37/0004<br>473/373 |
| 2011/0312445 | A1 * | 12/2011 | Sullivan | A63B 37/0043<br>473/376 |

* cited by examiner

MULTI-PIECE SOLID GOLF BALL

CROSS-REFERENCE TO RELATED APPLICATION

This application is a continuation-in-part of copending application Ser. No. 15/934,172 filed on Mar. 23, 2018, the entire contents of which are hereby incorporated by reference.

TECHNICAL FIELD

This invention relates to a multi-piece solid golf ball having a core with a two-layer construction consisting of an inner layer and an outer layer, and a cover of at least two layers including an intermediate layer and an outer layer with numerous dimples formed on the surface.

BACKGROUND ART

Golfers vary widely in their ability, from professional and skilled amateur golfers to amateur players having low head speeds, and so the requirements for golf balls also are diverse and individualized. A variety of investigations are being carried out on ball constructions in order to address such requirements.

In terms of ball construction, a number of multi-piece solid golf balls having multilayer constructions in which the core hardness, the cover hardness and moreover the dimples are variously improved have been proposed. In particular, multi-piece solid golf balls in which the core is formed into two layers are described in JP-A 2006-230661 (Patent Document 1), JP-A 2006-289065 (Patent Document 2), JP-A 2011-115593 (Patent Document 3) and U.S. Pat. No. 8,690,712 (Patent Document 4).

However, these golf balls have not been entirely satisfactory for obtaining good distances, both on shots with a driver (W #1) and also on full shots with various irons. Hence, there exists a need for golf balls which, when used by amateur golfers having a low head speed, are able to achieve a good distance on full shots with clubs ranging from a driver to iron clubs, and moreover have a soft, comfortable feel at impact.

SUMMARY OF THE INVENTION

It is therefore an object of the present invention to provide a golf ball which enables relatively low head-speed golfers to achieve a good distance on full shots with clubs ranging from a driver to iron clubs, and which moreover has a soft, pleasant feel at impact.

As a result of intensive investigations, the inventors have discovered that, in a multi-piece solid golf ball having a core, a cover of at least two layers including an intermediate layer and an outer layer and numerous dimples formed on the outer surface, certain advantages are provided by a ball construction wherein the hardest layer of the cover has a material hardness on the Shore D hardness scale of at least 56, the Shore D hardness value obtained by subtracting the surface hardness of the overall core from the surface hardness of the hardest cover layer is at least 2, the ball has a deflection when compressed under a final load of 1,275 N (130 kgf) from an initial load of 98 N (10 kgf) of at least 2.7 mm, and the value obtained by subtracting the initial velocity of the inner core layer from the initial velocity of the sphere consisting of the inner core layer encased by the outer core layer is at least 0.5 m/s. Specifically, such a ball construction holds down the spin rate of the ball on full shots and increases the initial velocity on shots in the low head speed range, thus providing a better distance on full shots taken with all clubs by golfers having a modest head speed on shots with a driver. Moreover, the ball has a soft, comfortable feel at impact.

That is, the objects of the invention can be achieved by way of, when the cover encasing the core is formed of two or more layers that include an intermediate layer and an outer layer, a core structure consisting of a relatively soft inner core layer and a relatively hard outer core layer and a cover structure consisting of a layer made of a resin material that is soft and has a high resilience and a resin material that is hard and has a high resilience. By making the resilience of the outer core layer higher than the resilience of the inner core layer, there can be obtained a ball which ensures a superior distance in the low-head-speed region. Moreover, by optimizing the hardness level of each member of the golf ball, a ball is achieved which, in addition to suppressing the spin rate and thereby ensuring a superior distance, also has a comfortable feel at impact. In this specification, "low-head-speed region" refers to a head speed of from 25 to 38 m/s on shots with a driver (W #1) and a head speed of from 22 to 35 m/s on full shots with a 6-iron (I #6).

Accordingly, in one aspect, the invention provides a multi-piece solid golf ball comprising a two-layer core consisting of an inner core layer and an outer core layer, and a cover of at least two layers including an intermediate layer and an outer layer having a surface with numerous dimples formed thereon, wherein the cover layer with the greatest hardness of all the cover layers has a material hardness on the Shore D hardness scale of at least 56, the Shore D hardness value obtained by subtracting the surface hardness of the overall core from the surface hardness of the hardest cover layer is at least 2, the ball has a deflection when compressed under a final load of 1,275 N (130 kgf) from an initial load of 98 N (10 kgf) of at least 2.7 mm, and the value obtained by subtracting the initial velocity of the inner core layer from the initial velocity of the sphere consisting of the inner core layer encased by the outer core layer is at least 0.5 m/s, and wherein the overall core has a hardness profile which, letting Cc be the JIS-C hardness at a center of the core and Cs be the JIS-C hardness at the core surface, satisfies the following condition:

$$(Cs)-(Cc)\geq 30.$$

In a preferred embodiment of the golf ball of the invention, the overall core has a hardness profile which, letting Cc+5 be the JIS-C hardness at a position 5 mm from the core center and Cs−5 be the JIS-C hardness at a position 5 mm inside the core surface, further satisfies the following conditions (1) to (3) below:

$$(Cc+5)-(Cc)\leq 5 \quad (1)$$

$$(Cs)-(Cs-5)\geq 10 \quad (2)$$

$$\{(Cs)-(Cs-5)\}/\{Cc+5\}-(Cc)\}\geq 4. \quad (3)$$

In another preferred embodiment, the inner core layer is formed of a rubber composition that includes two or more types of base rubber and the outer core layer is formed of a rubber composition that includes one or more type of base rubber.

In yet another preferred embodiment, letting V1 be the initial velocity (m/s) of the inner core layer, V2 be the initial velocity (m/s) of the sphere obtained by encasing the inner core layer with the outer core layer, V3 be the initial velocity (m/s) of the sphere obtained by encasing the core with the intermediate layer, and V4 be the initial velocity (m/s) of the ball, satisfies the condition: V4>V3≥V2>V1.

In still another preferred embodiment, the intermediate layer is formed primarily of a resin composition comprising:

a base resin of (a) an olefin-unsaturated carboxylic acid random copolymer or a metal ion neutralization product of an olefin-unsaturated carboxylic acid random copolymer or both blended with (b) an olefin-unsaturated carboxylic acid-unsaturated carboxylic acid ester random terpolymer or a metal ion neutralization product of an olefin-unsaturated carboxylic acid-unsaturated carboxylic acid ester random terpolymer or both in a weight ratio therebetween of from 100:0 and 0:100, (c) a fatty acid or fatty acid derivative having a molecular weight of from 228 to 1,500, and (d) a basic inorganic metal compound capable of neutralizing acid groups in the base resin and component (c).

In a further preferred embodiment, the material hardness of the cover outer layer is higher than the material hardness of the intermediate layer.

In another preferred embodiment, the number of dimples is from 250 to 370; the dimples are of at least three types; the dimple surface coverage SR, defined as the proportion of the spherical surface of the ball accounted for the dimples, is at least 75%; and the ball when struck has a coefficient of lift CL at a Reynolds number of 70,000 and a spin rate of 2,000 rpm which is at least 70% of the coefficient of lift CL at a Reynolds number of 80,000 and a spin rate of 2,000 rpm.

In yet another preferred embodiment, the dimples are of non-spherical shape and the ball surface has a land thereon which is surrounded by a plurality of the non-spherical dimples, the land having a shape that includes at least one vertex, being contiguous at substantially a point with each of at least two neighboring lands and having a surface area in the range of from 0.05 to 16.00 $mm^2$.

In a second aspect, the invention provides a multi-piece solid golf ball comprising a two-layer core consisting of an inner core layer and an outer core layer, and a cover of at least two layers including an intermediate layer and an outer layer having a surface with numerous dimples formed thereon, wherein the cover layer with the greatest hardness of all the cover layers has a material hardness on the Shore D hardness scale of at least 56, the Shore D hardness value obtained by subtracting the surface hardness of the overall core from the surface hardness of the hardest cover layer is at least 2, the ball has a deflection when compressed under a final load of 1,275 N (130 kgf) from an initial load of 98 N (10 kgf) of at least 2.7 mm, and the value obtained by subtracting the initial velocity of the inner core layer from the initial velocity of the sphere consisting of the inner core layer encased by the outer core layer is at least 0.5 m/s, and wherein the overall core has a hardness profile which, letting Cc be the JIS-C hardness at a center of the core, Cc+5 be the JIS-C hardness at a position 5 mm from the core center, Cs−5 be the JIS-C hardness at a position 5 mm inside the core surface, and Cs be the JIS-C hardness at the core surface, satisfies conditions (1) to (3) below:

$$(Cc+5)-(Cc)\leq 5 \quad (1)$$

$$(Cs)-(Cs-5)\geq 10 \quad (2)$$

$$\{(Cs)-(Cs-5)\}/\{Cc+5\}-(Cc)\}\geq 4. \quad (3)$$

Also, in a third aspect, the invention provides a multi-piece solid golf ball comprising a two-layer core consisting of an inner core layer and an outer core layer, and a cover of at least two layers including an intermediate layer and an outer layer having a surface with numerous dimples formed thereon, wherein the cover layer with the greatest hardness of all the cover layers has a material hardness on the Shore D hardness scale of at least 56, the Shore D hardness value obtained by subtracting the surface hardness of the overall core from the surface hardness of the hardest cover layer is at least 2, the ball has a deflection when compressed under a final load of 1,275 N (130 kgf) from an initial load of 98 N (10 kgf) of at least 2.7 mm, and the value obtained by subtracting the initial velocity of the inner core layer from the initial velocity of the sphere consisting of the inner core layer encased by the outer core layer is at least 0.5 m/s, and wherein the dimples are of non-spherical shape and the ball surface has a land thereon which is surrounded by a plurality of the non-spherical dimples, the land having a shape that includes at least one vertex, being contiguous at substantially a point with each of at least two neighboring lands and having a surface area in the range of from 0.05 to 16.00 $mm^2$.

Advantageous Effects of the Invention

The golf ball of the invention enables golfers having a relatively low head speed to achieve a good distance on full shots taken with a range of clubs from a driver to an iron, and moreover provides a good, comfortable feel at impact.

DESCRIPTION OF THE PREFERRED EMBODIMENTS

Figure 1A:
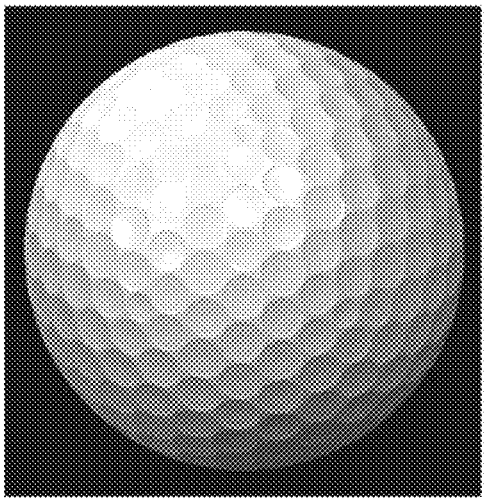
FIG. 1A, FIG. 1B, and FIG. 1C show plan views of the golf balls having dimples on the surface that were used in the Working Examples and the Comparative Examples, FIG. 1A being a plan view (photograph) of a ball that uses Type A dimples, FIG. 1B being a plan view (photograph) of a ball that uses Type B dimples, and FIG. 1C being a plan view of a ball that uses Type C dimples.

The objects, features and advantages of the invention will become more apparent to from the following detailed description taken in conjunction with the appended diagrams.

In the invention, the core is formed of two layers: an inner core layer and an outer core layer.

The inner core layer has a diameter that is preferably at least 10 mm, more preferably at least 15 mm, and even more preferably at least 20 mm. The upper limit is preferably not more than 30 mm, more preferably not more than 27.5 mm, and even more preferably not more than 25 mm. At an inner core layer diameter outside the above range, the spin rate-lowering effect on full shots may be inadequate and a good distance may not be obtained.

The inner core layer has a deflection when subjected to a specific load, i.e., a deflection when compressed under a final load of 1,275 N (130 kgf) from an initial load of 98 N (10 kgf), which deflection is also referred to below as the "inner core layer deflection T," that is preferably at least 4.0 mm, more preferably at least 5.0 mm, and even more preferably at least 6.0 mm. The upper limit is preferably not more than 10.0 mm, more preferably not more than 9.0 mm, and even more preferably not more than 8.0 mm. When this value is too small, i.e., when the inner core layer is too hard, the spin rate may rise excessively, resulting in a poor distance, or the feel at impact may become too hard. On the other hand, when this value is too large, i.e., when the inner core layer is too soft, the rebound may become too low, resulting in a poor distance, or the feel at impact may become too soft, as a result of which the durability to cracking under repeated impact may worsen.

The outer core layer is the layer that directly encases the inner core layer. This layer has a thickness of preferably at least 3 mm, more preferably at least 5 mm, and even more preferably at least 7 mm. The upper limit is preferably not more than 12 mm, more preferably not more than 10 mm, and even more preferably not more than 8 mm. At an outer core layer thickness outside the above range, the spin rate-lowering effect on full shots may be inadequate and a good distance may not be obtained.

The inner core layer and outer core layer materials are each composed primarily of a rubber material. The rubber material in the outer core layer encasing the inner core layer may be the same as or different from the rubber material in the inner core layer. Specifically, a rubber composition can be prepared using a base rubber as the chief component and including, together with this, other ingredients such as a co-crosslinking agent, an organic peroxide, an inert filler and an organosulfur compound. Polybutadiene is to preferably used as the base rubber.

Moreover, it is preferable for the inner core layer to be formed of a rubber composition that includes two or more types of base rubber and for the outer core layer to be formed of a rubber composition that includes one or more type of base rubber. With regard to the inner core layer material, to achieve both a good productivity and a suitable rebound performance, it is preferable to mix a low-resilience rubber into rubber composed primarily of polybutadiene (BR). Exemplary low-resilience rubbers include, but are not limited to, butyl rubber, polyisoprene (IR), styrene-butadiene rubber (SBR), natural rubber, fluororubber, chloroprene rubber, nitrile rubber, ethylene-propylene rubber, acrylic rubber, urethane rubber, and mixtures thereof. In the invention, a core construction consisting of a relatively soft inner core layer and a relatively hard outer core layer enables a good distance to be achieved on full shots with clubs ranging from a driver to iron clubs, and enables a good feel at impact to be obtained.

The polybutadiene serving as the above rubber ingredient typically has a cis-1,4 bond content on the polymer chain of at least 60 wt %, preferably at least 80 wt %, more preferably at least 90 wt %, and most preferably at least 95 wt %. When the cis-1,4-bonds account for too few of the bonds on the molecule, the resilience may decrease.

The polybutadiene typically has a 1,2-vinyl bond content on the polymer chain of not more than 2%, preferably not more than 1.7%, and more preferably not more than 1.5%. When the 1,2-vinyl bond content is too high, the resilience may decline.

The co-crosslinking agent is exemplified by unsaturated carboxylic acids and metal salts of unsaturated carboxylic acids. Specific examples of unsaturated carboxylic acids include acrylic acid, methacrylic acid, maleic acid and fumaric acid, with the use of acrylic acid and methacrylic acid being especially preferred. The metal salts of unsaturated carboxylic acids, although not particularly limited, are exemplified by the above unsaturated carboxylic acids that have been neutralized with a desired metal ion. Specific examples include zinc salts and magnesium salts of methacrylic acid and acrylic acid. The use of zinc acrylate is especially preferred.

The unsaturated carboxylic acid and/or metal salt thereof is included in an amount, per 100 parts by weight of the base rubber, of typically at least 5 parts by weight, preferably at least 9 parts by weight, and more preferably at least 13 parts by weight, with the upper limit being typically not more than 60 parts by weight, preferably not more than 50 parts by weight, more preferably not more than 40 parts by weight, and most preferably not more than 30 parts by weight. When the content is too high, the ball may become too hard and have an unpleasant feel at impact. When the content is too low, the rebound may decrease.

A commercial product may be used as the organic peroxide. Examples of such products that may be suitably used include Percumyl D, Perhexa C-40 and Perhexa 3M (all products of NOF Corporation), and Luperco 231XL (from AtoChem Co.). These may be used singly or two or more may be used together. The amount of organic peroxide included per 100 parts by weight of the base rubber is preferably at least 0.1 part by weight, more preferably at least 0.3 part by weight, even more preferably at least 0.5 part by weight, and most preferably at least 0.7 part by weight. The upper limit is preferably not more than 5 parts by weight, more preferably not more than 4 parts by weight, even more preferably not more than 3 parts by weight, and most preferably not more than 2.5 parts by weight. When too much or too little is included, it may not be possible to obtain a ball having a good feel, durability and rebound.

Another compounding ingredient included in the base rubber is an inert filler, preferred examples of which include zinc oxide, barium sulfate and calcium carbonate. One of these may be used alone, or two or more may be used together. The amount of inert filler included per 100 parts by weight of the base rubber is preferably at least 1 part by weight, and more preferably at least 5 parts by weight. The upper limit is preferably not more than 50 parts by weight, more preferably not more than 40 parts by weight, and even more preferably not more than 35 parts by weight. Too much or too little inert filler may make it impossible to obtain a proper weight and a good rebound.

In addition, an antioxidant may be optionally included. Illustrative examples of suitable commercial antioxidants include Nocrac NS-6 and Nocrac NS-30 (both available from Ouchi Shinko Chemical Industry Co., Ltd.), and Yoshinox 425 (available from Yoshitomi Pharmaceutical Industries, Ltd.). One of these may be used alone, or two or more may be used together.

The amount of antioxidant included per 100 parts by weight of the base rubber can be set to 0 or more part by weight, preferably at least 0.05 part by weight, and more preferably at least 0.1 part by weight. The upper limit is preferably not more than 3 parts by weight, more preferably not more than 2 parts by weight, even more preferably not more than 1 part by weight, and most preferably not more than 0.5 part by weight. Too much or too little antioxidant may make it impossible to achieve a suitable ball rebound and durability.

An organosulfur compound is preferably included in the outer core layer in order to impart a good resilience. The organosulfur compound is not particularly limited, provided it can enhance the rebound of the golf ball. Exemplary organosulfur compounds include thiophenols, thionaphthols, halogenated thiophenols, and metal salts of these. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and any of the following having 2 to 4 sulfur atoms: diphenylpolysulfides, dibenzylpolysulfides, dibenzoylpolysulfides, dibenzothiazoylpolysulfides and dithiobenzoylpolysulfides. The use of the zinc salt of pentachlorothiophenol is especially preferred. It is recommended that the amount of organosulfur compound included per 100 parts by weight of the base rubber be preferably at least 0.05 part by weight, more preferably at least 0.1 part by weight, and even more preferably at least 0.2 part by weight, and that the upper limit be preferably not more than 5 parts by weight, more preferably not more than 3 parts by weight, and even more preferably not more than 2.5 parts by weight. Including too much organosulfur compound may make a greater rebound-improving effect (particularly on shots with a W #1) unlikely to be obtained, may make the core too soft or may worsen the feel of the ball on impact. On the other hand, including too little may make a rebound-improving effect unlikely.

The methods for producing the inner core layer and the outer core layer are described. The inner core layer may be molded by a method in accordance with customary practice, such as that of forming the inner core layer material into a spherical shape under heating and compression at 140 to 180° C. for a period of from 10 to 60 minutes. The method used to form the outer core layer on the surface of the inner core layer may involve forming a pair of half-cups from unvulcanized rubber in sheet form, placing the inner core layer within these cups so as to encapsulate it, and then molding under applied heat and pressure. For example, suitable use can be made of a process wherein, following initial vulcanization (semi-vulcanization) to produce a pair of hemispherical cups, the prefabricated inner core layer is placed in one of the hemispherical cups and then covered with the other hemispherical cup, in which state secondary vulcanization (complete vulcanization) is carried out. Alternatively, suitable use can be made of a process which divides vulcanization into two stages by rendering an unvulcanized rubber composition into sheet form so as to produce a pair of outer core layer-forming sheets, stamping the sheets using a die provided with a hemispherical protrusion to produce unvulcanized hemispherical cups, and subsequently covering a prefabricated inner core layer with a pair of these hemispherical cups and forming the whole into a spherical shape by heating and compression at 140 to 180° C. for a period of from 10 to 60 minutes.

The deflection under specific loading of the overall core consisting of the inner core layer and the outer core layer, that is, the deflection of the overall core when compressed under a final load of 1,275 N (130 kgf) from an initial load of 98 N (10 kgf) (also referred to below as "the deflection P of the overall core"), is preferably at least 3.0 mm, more preferably at least 3.5 mm, and even more preferably at least 4.0 mm, and has an upper limit of preferably not more than 6.0 mm, more preferably not more than 5.5 mm, and even more preferably not more than 5.0 mm. When this value is too small, that is, when the core is too hard, the spin rate may rise excessively and the ball may not achieve a good distance, or the feel at impact may be too hard. On the other hand, when this value is too large, that is, when the core is too soft, the resilience may be too low and the ball may not achieve a good distance, or the feel at impact may be too soft and the durability to cracking on repeated impact may worsen.

The core has a surface hardness (Cs) which, on the JIS-C hardness scale, is preferably at least 75, more preferably at least 79, and even more preferably at least 82. The upper limit on the JIS-C hardness scale is preferably not more than 95, more preferably not more than 91, and even more preferably not more than 88. The surface hardness of the core, expressed on the Shore D hardness scale, is preferably at least 49, more preferably at least 52, and even more preferably at least 54. The upper limit is preferably not more than 64, more preferably not more than 61, and even more preferably not more than 59. When this value is too large, the feel at impact may become hard or the durability to cracking on repeated impact may worsen. On the other hand, when this value is too small, the resilience may be low or the spin rate on full shots may rise, as a result of which a good distance may not be achieved.

The hardness 5 mm inside the core surface (Cs−5), expressed on the JIS-C hardness scale, is preferably at least 55, more preferably at least 59, and even more preferably at least 62. The upper limit on the JIS-C hardness scale is preferably not more than 80, more preferably not more than 76, and even more preferably not more than 73. When this value is too large, the feel at impact may become hard or the durability to cracking on repeated impact may worsen. On the other hand, when this value is too small, the resilience may decrease or the spin rate on full shots may rise, as a result of which a good distance may not be achieved.

The hardness 5 mm outside the core center (Cc+5), expressed on the JIS-C hardness scale, is preferably at least 34, more preferably at least 37, and even more preferably at least 40. The upper limit on the JIS-C hardness scale is preferably not more than 63, more preferably not more than 60, and even more preferably not more than 57. When this value is too small, the durability to cracking on repeated impact may worsen or the initial velocity may become too low and so a good distance may not be obtained. On the other hand, when this value is too large, the feel at impact on full shots may become too hard, or the spin rate may rise, as a result of which a good distance may not be obtained.

The core center hardness (Cc) on the JIS-C hardness scale is preferably at least 34, more preferably at least 37, and even more preferably at least 40. The upper limit in the JIS-C hardness is preferably not more than 60, more preferably not more than 57, and even more preferably not more than 54. The core center hardness on the Shore D hardness scale is preferably at least 18, more preferably at least 20, and even more preferably at least 22. The upper limit is preferably not more than 38, more preferably not more than 35, and even more preferably not more than 33. When this value is too small, the durability on repeated impact may worsen or the initial velocity may become too low, as a result of which a good distance may not be achieved. On the other hand, when this value is too large, the feel at impact on full shots may become too hard, or the spin rate may rise, as a result of which a good distance may not be achieved.

The overall core has a hardness profile which preferably satisfies conditions (1) to (3) below:

$$(Cc+5)-(Cc)\leq 5 \quad (1)$$

$$(Cs)-(Cs-5)\geq 10 \quad (2)$$

$$\{(Cs)-(Cs-5)\}/\{Cc+5\}-(Cc)\}\geq 4. \quad (3)$$

The value (Cc+5)−(Cc) is preferably not more than 5, more preferably not more than 4, and even more preferably not more than 3. The lower limit is 0 or more.

The value (Cs)−(Cs−5) is preferably at least 10, more preferably at least 12, and even more preferably at least 14. The upper limit value is preferably not more than 25, and more preferably not more than 20.

The value {(Cs)−(Cs−5)}/{Cc+5}−(Cc)} is preferably at least 4. This value signifies that the gradient in the core hardness profile near the core surface is at least four times larger than the gradient in the core hardness profile near the core center. This value is preferably at least 5, and more preferably at least 6. The upper limit is preferably not more than 50, and more preferably not more than 40.

The core surface hardness (Cs)−core center hardness (Cc) value, expressed on the JIS-C hardness scale, is preferably at least 30, more preferably at least 31, and even more preferably at least 32. The upper limit, expressed on the JIS-C hardness scale, is preferably not more than 50, more preferably not more than 47, and even more preferably not more than 43. When this hardness difference is too small, the spin rate on full shots may rise and a good distance may not be achieved. On the other hand, when this value is too large, the durability to cracking on repeated impact may worsen.

With regard to the relationship between the deflection T of the inner core layer and the deflection P of the overall core, the value T/P is preferably at least 1.2, more preferably at least 1.3, and even more preferably at least 1.4. The upper limit is preferably not more than 1.8, more preferably not more than 1.7, and even more preferably not more than 1.6. When this value is too small, the spin rate on full shots may rise, resulting in a poor distance. When this value is too large, the durability to cracking under repeated impact may worsen or the initial velocity may become too low, as a result of which a good distance may not be achieved.

The initial velocities of the inner core layer and the core (overall core) can be measured using an initial velocity measuring apparatus of the same type as the United States Golf Association (USGA) drum rotation-type initial velocity instrument approved by The Royal and Ancient Golf Club of St. Andrews (R&A). In this case, the core can be tested in a 23.9±2° C. chamber after being held isothermally at a temperature of 23.9±1° C. for at least 3 hours. The value obtained by subtracting the initial velocity of the inner core layer from the initial velocity of the overall core is at least 0.5 m/s, preferably at least 1.0 m/s, more preferably at least 1.3 m/s, and even more preferably at least 1.6 m/s. The upper limit is preferably not more than 2.5 m/s, and more preferably not more than 2.0 m/s. When this value is too small, the initial velocity of the ball on actual shots with a driver (W #1) or an iron club at a low head speed may be low, as a result of which the intended distance may not be obtained. On the other hand, when this value is too large, the initial velocity of the overall ball cannot be set to a value close to the upper limit specified in the Rules of Golf, as a result of which a good distance may not be achieved under all hitting conditions.

In the present invention, the cover used in this invention has at least two layers including an intermediate layer and an outer layer. The number of the cover layers may be more than two.

The materials making up the layers of the cover may be composed primarily of various thermoplastic resin materials used as cover stock in golf balls. It is especially suitable to use a resin composition composed primarily of an ionomer resin, or to use the highly neutralized resin material described below.

The highly neutralized resin material is an acid-containing resin material which includes, as an essential component, a base resin obtained by blending specific amounts of the following:

(a) an olefin-unsaturated carboxylic acid random copolymer and/or a metal ion neutralization product of an olefin-unsaturated carboxylic acid random copolymer, and (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer.

Commercial products may be used as components (a) and (b). Illustrative examples of the random copolymer in component (a) include Nucrel® N1560, Nucrel® N1214, Nucrel® N1035 and Nucrel® AN4221C (all products of DuPont-Mitsui Polychemicals Co., Ltd.). Illustrative examples of the random copolymer of component (b) include Nucrel® AN4311, Nucrel® AN4318 and Nucrel® AN4319 (all products of DuPont-Mitsui Polychemicals Co., Ltd.).

Illustrative examples of the metal ion neutralization product of the random copolymer in component (a) include Himilan® 1554, Himilan® 1557, Himilan® 1601, Himilan® 1605, Himilan® 1706 and Himilan® AM7311 (all products of DuPont-Mitsui Polychemicals Co., Ltd.), and Surlyn® 7930 (E.I. DuPont de Nemours & Co.). Illustrative examples of the metal ion neutralization product of the random copolymer in component (b) include Himilan® 1855, Himilan® 1856 and Himilan® AM7316 (all products of DuPont-Mitsui Polychemicals Co., Ltd.), and Surlyn® 6320, Surlyn® 8320, Surlyn® 9320 and Surlyn® 8120 (all products of E.I. DuPont de Nemours & Co.). Sodium-neutralized ionomer resins that are suitable as metal ion neutralization products of these random copolymers include Himilan® 1605, Himilan® 1601 and Himilan® 1555.

When preparing the base resin, the weight ratio in which components (a) and (b) are blended may be set to generally between 100:0 and 0:100. The ratio of component (b) with respect to the combined amount of components (a) and (b) may be set to preferably at least 50 wt %, more preferably at least 60 wt %, and most preferably at least 70 wt %.

A non-ionomeric thermoplastic elastomer (e) may be added to the base resin so as to enhance even further the feel of the ball at impact and the ball rebound. Examples of component (e) include olefin elastomers, styrene elastomers, polyester elastomers, urethane elastomers and polyamide elastomers. In this invention, to further increase the rebound, it is preferable to use a polyester elastomer or an olefin elastomer. The use of an olefin elastomer consisting of a thermoplastic block copolymer which includes crystalline polyethylene blocks as the hard segments is especially preferred.

A commercial product may be used as component (e). Examples include Dynaron® (JSR Corporation) and the polyester elastomer Hytrel® (DuPont-Toray Co., Ltd.).

Component (e) may be included in an amount of 0 part by weight or more. There is no particular upper limit in the content thereof, although the amount of component (e) included per 100 parts by weight of the base resin may be set to preferably not more than 100 parts by weight, more preferably not more than 60 parts by weight, even more preferably not more than 50 parts by weight, and most preferably not more than 40 parts by weight. When the component (e) content is too high, the compatibility of the mixture may decrease and the durability of the golf ball may markedly decline.

A fatty acid or fatty acid derivative having a molecular weight of at least 228 and not more than 1,500 may be added as component (c) to the base resin. Compared with the base resin, this component (c) has a very low molecular weight. This component suitably adjusts the melt viscosity of the mixture, thereby helping in particular to improve the flow properties. Also, component (c) includes a relatively high content of acid groups (or derivatives thereof), and is able to suppress an excessive loss of resilience.

The amount of component (c) included per 100 parts by weight of the resin component obtained by suitably blending components (a), (b) and (e) may be set to at least 5 parts by weight, preferably at least 10 parts by weight, more preferably at least 15 parts by weight, and even more preferably at least 18 parts by weight. The upper limit in the amount of component (c) may be set to not more than 100 parts by weight, preferably not more than 80 parts by weight, and more preferably not more than 60 parts by weight. When the amount of component (c) included is too low, the melt viscosity may decrease, lowering the processability; when the amount included is too high, the durability may decrease.

A basic inorganic metal compound capable of neutralizing acid groups in the base resin and component (c) may be added as component (d). By including component (d), the acid groups present in the base resin and component (c) are neutralized and, owing to synergistic effects from the blending of these components, the thermal stability of the resin composition increases. At the same time, a good moldability is imparted, enabling the resilience of the molded product to be enhanced.

The amount of component (d) included per 100 parts by weight of the resin component may be set to at least 0.1 part by weight, preferably at least 0.5 part by weight, and more preferably at least 1 part by weight. The upper limit may be set to not more than 17 parts by weight, preferably not more than 15 parts by weight, more preferably not more than 13 parts by weight, and even more preferably not more than 10 parts by weight. Including too little component (d) may fail to improve thermal stability and resilience, whereas including too much may instead lower the heat resistance of the golf ball material owing to the presence of excess basic inorganic metal compound.

As mentioned above, by including specific amounts of components (c) and (d) with respect to the resin component composed of the base resin obtained by blending specific amounts of components (a) and (b) in admixture with optional component (e), a material of excellent thermal stability, flow properties and moldability can be obtained, and the resilience of the resulting molded product can be dramatically improved.

It is recommended that the material obtained by blending specific amounts of the resin component and components (c) and (d) have a high degree of neutralization (i.e., that it be highly neutralized). Specifically, it is recommended that at least 50 mol %, preferably at least 60 mol %, more preferably at least 70 mol %, and even more preferably at least 80 mol %, of the acid groups in the material be neutralized. High neutralization of acid groups in the material makes it possible to more reliably suppress the exchange reactions that cause trouble when only a base resin and a fatty acid (or fatty acid derivative) are used as in the above-cited prior art, thus preventing the generation of fatty acid. As a result, the thermal stability is greatly improved and the moldability is good, enabling molded products to be obtained which have an excellent resilience compared with conventional ionomer resins.

Here, "degree of neutralization" refers to the degree of neutralization of acid groups present within the mixture of the base resin and the fatty acid (or fatty acid derivative) serving as component (c), and differs from the degree of neutralization of the ionomer resin itself in cases where an ionomer resin is used as the metal ion neutralization product of a random copolymer in the base resin. On comparing such a mixture having a certain degree of neutralization with an ionomer resin alone having the same degree of neutralization, the mixture, by including component (d), contains a very large number of metal ions and thus has a higher density of ionic crosslinks which contribute to improved resilience, making it possible to confer the molded product with an excellent resilience.

Optional additives may be suitably included in the highly neutralized resin material in accordance with the intended use. For example, various additives such as pigments, dispersants, antioxidants, ultraviolet absorbers and light stabilizers may be added. When such additives are included, the amount thereof, per 100 parts by weight of components (a) to (e) combined, is preferably at least 0.1 part by weight, and more preferably at least 0.5 part by weight, with the upper limit being preferably not more than 10 parts by weight, and more preferably not more than 4 parts by weight.

The cover used in this invention has at least two layers which include an intermediate layer and an outer layer. Cases where the cover has two or more layers encompass both soft inner/hard outer-type cover constructions and hard inner/soft outer-type cover constructions. That is, both cases in which the intermediate layer is harder than the outer layer and cases in which the intermediate layer is softer than the outer layer fall within the scope of the invention. However, in this invention, by endowing the cover layer having the greatest hardness of all the cover layers with a material hardness on the Shore D hardness scale of at least 56 and by having the Shore D hardness value obtained by subtracting the surface hardness of the overall core from the surface hardness of the hardest cover layer be at least 2, it is possible to obtain a good distance on full shots taken with any club ranging from a driver to an iron, and also to obtain a soft, comfortable feel at impact.

The hardest of the cover layers has a material hardness on the Shore D hardness scale of at least 56, preferably at least 59, more preferably at least 61, and even more preferably at least 62. The upper limit is preferably not more than 70, more preferably not more than 68, and even more preferably not more than 65.

The surface hardness of the hardest of the various cover layers, i.e., the surface hardness of the sphere encased by the hardest layer, expressed in terms of Shore D hardness, is preferably at least 62, more preferably at least 65, and even more preferably at least 68. The upper limit is preferably not more than 76, more preferably not more than 74, and even more preferably not more than 71. The Shore D hardness value obtained by subtracting the surface hardness of the overall core from the surface hardness of the hardest layer is at least 2, preferably at least 6, and more preferably at least 10. When this value is too small, the spin rate on full shots with a driver (W #1) rises and a sufficient distance is not achieved.

In cases where the cover used in the invention includes an intermediate layer and an outer layer, the intermediate layer and the outer layer are constituted are described below.

The intermediate layer has a material hardness on the Shore D hardness scale of preferably at least 40, more preferably at least 44, and even more preferably at least 47. The upper limit is preferably not more than 65, more preferably not more than 60, and even more preferably not more than 55. The sphere obtained by encasing the core with the intermediate layer (referred to below as the "intermediate layer-encased sphere") has a surface hardness on the Shore D hardness scale of preferably at least 46, more preferably at least 50, and even more preferably at least 53. The upper limit is preferably not more than 71, more preferably not more than 66, and even more preferably not more than 61. When softer than this range, the spin rate on shots with a driver (W #1) or an iron club may become too high, as a result of which the intended distance may not be achieved. When harder than this range, the durability to cracking on repeated impact may worsen or the feel at impact may become too hard.

The intermediate layer has a thickness which is preferably at least 0.7 mm, more preferably at least 1.0 mm, and even more preferably at least 1.2 mm. The upper limit is preferably not more than 2.0 mm, more preferably not more than 1.5 mm, and even more preferably not more than 1.3 mm. When the thickness of the intermediate layer falls outside of this range, the spin rate-lowering effect on shots with a driver (W #1) may be inadequate and a good distance may not be achieved.

The intermediate layer-encased sphere has a deflection under specific loading, i.e., the deflection of the intermediate layer-encased sphere when compressed under a final load of 1,275 N (130 kgf) from an initial load of 98 N (10 kgf) (which deflection is also referred to below as the "intermediate layer-encased sphere deflection Q") is preferably at least 3.3 mm, more preferably at least 3.5 mm, and even more preferably at least 3.7 mm. The upper limit is preferably not more than 5.2 mm, more preferably not more than 4.7 mm, and even more preferably not more than 4.2 mm. When this value is too small, the feel may be too hard and the spin rate on shots with a driver (W #1) at a low head speed or on shots with an iron may rise, as a result of which a good distance may not be achieved. On the other hand, when this value is too large, the durability to cracking on repeated impact may worsen or the initial velocity of the ball may not come close to the upper limit specified in the Rules of Golf, as a result of which the initial velocity on all shots may become low and a good distance may not be achieved.

It is preferable to use in particular the above-described highly neutralized resin material as the resin material making up the intermediate layer.

The outer layer has a material hardness on the Shore D hardness scale of preferably at least 56, more preferably at least 59, and even more preferably at least 61. The upper limit is preferably not more than 70, more preferably not more than 68, and even more preferably not more than 65. The sphere obtained by encasing the intermediate layer-encased sphere with the outer layer has a surface hardness (also referred to below as "the surface hardness of the ball") which, on the Shore D hardness scale, is preferably at least 62, more preferably at least 65, and even more preferably at least 68. The upper limit is preferably not more than 76, more preferably not more than 74, and even more preferably not more than 71. When softer than this range, the spin rate on shots with a driver (W #1) or an iron club may become too high, as a result of which the intended distance may not be achieved. On the other hand, when harder than this range, the durability to cracking on repeated impact may worsen or the feel at impact may be too hard.

The outer layer has a thickness which is preferably at least 0.5 mm, more preferably at least 1.0 mm, and even more preferably at least 1.2 mm. The upper limit is preferably not more than 1.7 mm, more preferably not more than 1.5 mm, and even more preferably not more than 1.3 mm. Outside of this range, the spin rate-lowering effect on shots with a driver (W #1) may be inadequate and a good distance may not be obtained.

It is especially preferable to use an ionomer resin as the resin material of the outer layer, which ionomer resin may be a commercial product. Moreover, of commercial ionomer resins, a high-acid content ionomer resin having an acid content of at least 16% is used as the resin material of the outer layer, this high-acid content ionomer resin being included in an amount of preferably at least 25 wt %, and more preferably at least 50 wt %, of the overall cover material. A high rebound and a good spin rate-lowering effect can be thus obtained, enabling a good distance to be achieved on shots with a driver (W #1).

The manufacture of multi-piece solid golf balls in which the above-described core, intermediate layer and outer layer are formed as successive layers may be carried out by a customary method such as a known injection molding process. For example, a multi-piece golf ball can be produced by injection-molding an intermediate layer material over the core so as to obtain an intermediate layer-encased sphere, and then injection-molding an outer layer material over the intermediate layer-encased sphere. Alternatively, the encasing layers may each be formed by enclosing the sphere to be encased within two half-cups that have been pre-molded into hemispherical shapes and then molding under applied heat and pressure.

The deflection under specific loading of the sphere obtained by encasing the intermediate layer-encased sphere with the outer layer, i.e., the deflection of the overall ball when compressed under a final load of 1,275 N (130 kgf) from an initial load of 98 N (10 kgf) (also referred to below as "the ball deflection R") is preferably at least 2.7 mm, more preferably at least 2.8 mm, and even more preferably at least 2.9 mm. The upper limit is preferably not more than 4.0 mm, and more preferably not more than 3.5 mm. When this value is too small, the feel at impact may become too hard or the spin rate on low head speed shots with a driver (W #1) or an iron may rise, as a result of which a good distance may not be achieved. On the other hand, when this value is too large, the durability to cracking on repeated impact may worsen or the initial velocity of the ball may not come close to the upper limit specified in the Rules of Golf, as a result of which the desired distance on all shots may be low and a good distance may not be achieved.

The initial velocity of the ball can be measured using an initial velocity measurement apparatus under conditions similar to those used for measuring the initial velocity of the inner core layer and core as described above. In this case, the initial velocity of the ball is preferably at least 76.5 m/s, more preferably at least 76.8 m/s, and even more preferably at least 77.0 m/s. The upper limit is preferably not more than 77.724 m/s. When the ball initial velocity exceeds this range, the ball exceeds the R&A specifications and therefore cannot be recognized as an official ball. On the other hand, when the ball initial velocity is smaller than this range, the initial velocity under all impact conditions may become low and a good distance may not be obtained.

The golf ball of the invention preferably satisfies the following conditions.

The value obtained by subtracting the core surface hardness from the surface hardness of the intermediate layer-encased sphere is preferably from −2 to 20, more preferably from 0 to 14, and even more preferably from 1 to 7. When this value is too small, the spin rate on full shots may rise and a good distance may not be obtained. On the other hand, when this value is too large, the durability to cracking on repeated impact may worsen or the feel at impact may worsen.

The value obtained by subtracting the core surface hardness from the ball surface hardness, expressed in terms of Shore D hardness, is preferably from −2 to 20, more preferably from 3 to 17, and even more preferably from 8 to 15. When this value is too small, the spin rate on full shots may rise and a good distance may not be obtained. On the other hand, when this value is too large, the durability to cracking on repeated impact may worsen or the feel at impact may worsen.

The value obtained by subtracting the surface hardness of the intermediate layer-encased sphere from the ball surface hardness, expressed in terms of Shore D hardness, is preferably from −35 to 40, more preferably larger than 0 and not more than 25, and even more preferably from 5 to 15. When this value is too small, it becomes difficult to set the initial velocity of the overall ball close to the upper limit value under the Rules of Golf, and so a good distance may not be obtained under all impact conditions. On the other hand, when this value is too large, the durability to cracking on repeated impact may worsen.

The sum of the deflection P of the overall core, the deflection Q of the intermediate layer-encased sphere and the ball deflection R is preferably from 10 to 13.5 mm, more preferably from 10.5 to 13 mm, and even more preferably from 11 to 12.5 mm. When this value is too small, the feel at impact may be too hard or the spin rate on low head speed shots with a driver (W #1) or on shots with an iron may be high, as a result of which a good distance may not be obtained. On the other hand, when this value is too large, the durability to cracking on repeated impact may worsen or the initial velocity of the ball may not come close to the upper limit specified in the Rules of Golf, as a result of which the initial velocity on all shots may be low and a good distance may not be achieved.

The difference between the inner core layer deflection T and the ball deflection R, expressed as the value T-R, is preferably from 1.9 to 5.3 mm, more preferably from 2.3 to 4.9 mm, and even more preferably from 2.8 to 4.5 mm. When this value is too small, the spin rate on full shots rises and a good distance may not be obtained. On the other hand, when this value is too large, the durability to cracking on repeated impact may worsen.

Letting V1 be the initial velocity (m/s) of the inner core layer, V2 be the initial velocity (m/s) of the sphere obtained by encasing the inner core layer with the outer core layer (overall core), V3 be the initial velocity (m/s) of the sphere obtained by encasing the core with the intermediate layer (intermediate layer-encased sphere), and V4 be the initial velocity (m/s) of the ball, the inventive golf ball preferably satisfies the condition: $V4>V3\geq V2>V1$. When the initial velocity relationship among the various spheres does not satisfy this condition, it may be impossible to design a ball that achieves an excellent distance on low head speed shots taken with a driver (W #1) and on iron shots.

The value obtained by subtracting the initial velocity V2 of the overall core from the initial velocity V3 of the intermediate layer-encased sphere is preferably at least 0 m/s, more preferably from 0.1 to 1.0 m/s, and even more preferably from 0.2 to 0.5 m/s. When this value is too small, the spin rate on full shots may rise and a good distance may not be obtained. On the other hand, when this value is too large, the durability to cracking on repeated impact may worsen or the ball may have a poor feel at impact.

The value obtained by subtracting the initial velocity V3 of the intermediate layer-encased sphere from the initial velocity V4 of the ball is preferably from −1 to 1.0 m/s, more preferably from −0.4 to 0.7 m/s, and even more preferably from 0.2 to 0.5 m/s. When this value is too small, the initial velocity of the overall ball cannot be set to a value close to the upper limit value under the Rules of Golf; moreover, the spin rate on full shots may rise and a good distance may not obtained. On the other hand, when this value is too large, the durability to cracking on repeated impact may worsen.

The value obtained by subtracting the thickness of the outer layer from the thickness of the intermediate layer is preferably from −0.5 to 1.0 mm, more preferably from −0.3 to 0.6 mm, and even more preferably from −0.1 to 0.3 mm. When this value is too small, the durability to cracking on repeated impact may be poor. On the other hand, when this value is too large, the spin rate on full shots may rise and a good distance may not be obtained.

Numerous dimples may be formed on the outer surface of the cover (outermost layer). The number of dimples arranged on the outer surface of the cover may be set to preferably at least 250, more preferably at least 270, and even more preferably at least 300, with the upper limit being preferably not more than 370, more preferably not more than 350, and even more preferably not more than 340. When the number of dimples is higher than this range, the ball trajectory may become low, as a result of which the distance traveled by the ball may decrease. On the other hand, when the number of dimples is lower than this range, the ball trajectory may become high, as a result of which a good distance may not be achieved.

With regard to the shape of the dimples, suitable use may be made of one or a combination of two or more types of shapes from among, for example, circular shapes as well as oval shapes, various polygonal shapes, dewdrop shapes and other noncircular shapes. When circular dimples are used, the dimple diameter may be set to from about 2.5 mm up to about 6.5 mm, and the dimple depth may be set to from 0.08 mm to 0.30 mm.

When the dimple shapes are noncircular, the following approach can be taken. Two neighboring non-dimple regions on the surface of the ball (which regions are referred to below as "lands") can be made contiguous with each other at vertices thereof Alternatively, lands having a substantially concave polygonal shape can be made contiguous, at some or all vertices thereon, with neighboring lands. The length of the outer periphery of a land can be set to from 1.6 mm to 19.4 mm, and the length of the outer periphery of a dimple can be set to from 3.2 mm to 38.8 mm. The entire surface of the dimple can be made a smooth curved surface. A single dimple may be arranged so as to be contiguous with four or more such lands. A single dimple may be arranged so as to be contiguous with six or fewer such lands. The number of lands may be set to from 434 to 863. The lands may be given a shape that is inscribed in a triangle.

In order to be able to fully manifest the aerodynamic properties of the dimples, it is desirable for the dimple coverage ratio on the spherical surface of the golf ball, i.e., the dimple surface coverage SR, which is the sum of the individual dimple surface areas, each defined by the flat plane circumscribed by the edge of a dimple, as a percentage of the spherical surface area of the ball were the ball to have no dimples thereon, to be set to from 60% to 90%. Also, to optimize the ball trajectory, it is desirable for the value $V_0$, defined as the spatial volume of the individual dimples below the flat plane circumscribed by the dimple edge, divided by the volume of the cylinder whose base is the flat plane and whose height is the maximum depth of the dimple from the base, to be set to at least 0.35 and not more than 0.80. Moreover, it is preferable for the ratio VR of the sum of the volumes of the individual dimples, each formed below the flat plane circumscribed by the edge of a dimple, with respect to the volume of the ball sphere were the ball surface to have no dimples thereon, to be set to at least 0.6% and not more than 1.0%. Outside of the above ranges in these respective values, the resulting trajectory may not enable a good distance to be obtained, and so the ball may fail to travel a fully satisfactory distance.

Moreover, to obtain the desired distance-increasing effect, it is preferable to suitably adjust the coefficient of drag CD or the coefficient of lift CL, and especially preferable to set the coefficient of drag CD under high-velocity conditions to a low value and the coefficient of lift CL under low-velocity conditions to a high value. Specifically, it is desirable for the coefficient of lift CL when the Reynolds number is 70,000 and the spin rate is 2,000 rpm just prior to the ball reaching the highest point on its trajectory to be held to preferably at least 70%, and more preferably at least 75%, of the coefficient of lift CL when the Reynolds number is 80,000 and the spin rate is 2,000 rpm shortly therebefore.

The golf ball of the invention can be made to conform to the Rules of Golf for play. Specifically, the inventive ball may be formed to a diameter which is such that the ball does not pass through a ring having an inner diameter of 42.672 mm and is not more than 42.80 mm, and to a weight which is preferably from 45.0 to 45.93 g.

EXAMPLES

The following Examples and Comparative Examples are provided to illustrate the invention, and are not intended to limit the scope thereof.

Examples 1 to 4, Comparative Examples 1 to 5

Formation of Core

In each Example, an inner core layer was produced after vulcanizing the rubber composition formulated as shown in Table 1 at 155° C. for 15 minutes. Next, a rubber composition formulated as shown in Table 2 was rendered into sheet form in an unvulcanized state so as to produce a pair of outer core layer-forming sheets, and the sheets were stamped using a die provided with a hemispherical protrusion. The unvulcanized rubber thus stamped from the outer core-layer-forming sheets so as to conform with the mold cavity was then covered over the inner core layer and vulcanized at 155° C. for 15 minutes, thereby producing a two-layer core consisting of inner and outer layers. The core used in Comparative Example 4 was a single-layer core obtained by vulcanizing at 155° C. for 15 minutes the rubber composition formulated as shown in Table 1.

TABLE 1

| Inner core layer formulations | Working Example | | | | Comparative Example | | | | |
|---|---|---|---|---|---|---|---|---|---|
| (pbw) | 1 | 2 | 3 | 4 | 1 | 2 | 3 | 4 | 5 |
| Polybutadiene I | 60 | 60 | 60 | 60 | 80 | 60 | 60 | | 60 |
| Polyisoprene rubber | 40 | 40 | 40 | 40 | | 40 | 40 | | 40 |
| Polybutadiene II | | | | | 20 | | | 100 | |
| Organic peroxide (1) | 0.6 | 0.6 | 0.6 | 0.6 | 0.6 | 0.6 | 0.6 | 0.3 | 0.6 |
| Organic peroxide (2) | 0.6 | 0.6 | 0.6 | 0.6 | 0.6 | 0.6 | 0.6 | 0.3 | 0.6 |
| Barium sulfate | 28.4 | 26.6 | 26.6 | 28.4 | 30.9 | 26.6 | 24.8 | 24.1 | 26.6 |
| Zinc oxide | 4 | 4 | 4 | 4 | 4 | 4 | 4 | 4 | 4 |
| Antioxidant | 0.1 | 0.1 | 0.1 | 0.1 | 0.1 | 0.1 | 0.1 | 0.1 | 0.1 |
| Zinc acrylate | 14.0 | 18.3 | 18.3 | 14.0 | 9.8 | 18.3 | 22.6 | 26.0 | 18.3 |
| Zinc salt of pentachlorothiophenol | 0.1 | 0.1 | 0.1 | 0.1 | 0.1 | 0.1 | 0.1 | 0.1 | 0.1 |

TABLE 2

| Outer core layer formulations | Working Example | | | | Comparative Example | | | | |
|---|---|---|---|---|---|---|---|---|---|
| (pbw) | 1 | 2 | 3 | 4 | 1 | 2 | 3 | 4 | 5 |
| Polybutadiene I | 80 | 80 | 80 | 80 | 80 | 80 | 80 | — | 80 |
| Polyisoprene rubber | | | | | | | | — | |
| Polybutadiene II | 20 | 20 | 20 | 20 | 20 | 20 | 20 | — | 20 |
| Organic peroxide (1) | | | | | | | | — | |
| Organic peroxide (2) | 2.5 | 2.5 | 2.5 | 2.5 | 2.5 | 2.5 | 2.5 | — | 2.5 |
| Barium sulfate | 22.0 | 22.0 | 22.0 | 22.0 | 23.6 | 16.7 | 16.7 | — | 22.0 |
| Zinc oxide | 4 | 4 | 4 | 4 | 4 | 4 | 4 | — | 4 |
| Antioxidant | 0.1 | 0.1 | 0.1 | 0.1 | 0.1 | 0.1 | 0.1 | — | 0.1 |
| Zinc acrylate | 28.6 | 28.6 | 28.6 | 28.6 | 25.6 | 41.2 | 41.2 | — | 28.6 |
| Zinc salt of pentachlorothiophenol | 1.0 | 1.0 | 1.0 | 1.0 | 0.1 | 1.0 | 1.0 | — | 1.0 |

Details on the core materials are given below. The numbers in the tables indicate parts by weight.

Polybutadiene I: Available under the trade name "BR01" from JSR Corporation Polyisoprene: Available under the trade name "IR2200" from JSR Corporation Polybutadiene II: Available under the trade name "BR51" from JSR Corporation Organic peroxide (1): Dicumyl peroxide, available under the trade name "Percumyl D" from NOF Corporation Organic peroxide (2): A mixture of 1,1-di(t-butylperoxy) cyclohexane and silica, available under the trade name "Perhexa C-40" from NOF Corporation Antioxidant: 2,2'-Methylenebis(4-methyl-6-t-butylphenol), available under the trade name "Nocrac NS-6" from Ouchi Shinko Chemical Industry Co., Ltd.

Barium sulfate: Available under the trade name "Barico #300" from Hakusui Tech

Zinc oxide: Available as "Zinc Oxide Grade 3" from Sakai Chemical Co., Ltd.

Zinc salt of pentachlorothiophenol: Available from Zhejiang Cho & Fu Chemical

Formation of Intermediate Layer and Outer Layer

Next, using formulation No. 1 shown in Table 3 as the intermediate layer-forming resin material, this resin material was injection-molded over the core obtained as described above, thereby giving an intermediate layer-encased sphere. Then, using formulation No. 2 or No. 3 shown in Table 3 as the outer layer-forming resin material, this resin material was injection-molded over the intermediate layer-encased sphere obtained as described above, thereby giving the multi-piece solid golf balls in the respective Working Examples and Comparative Examples.

TABLE 3

| Resin material (pbw) | Content (%) | No. 1 | No. 2 | No. 3 |
|---|---|---|---|---|
| AM7318 | 18 | | 75 | |
| AM7327 | 7 | | 25 | |
| Surlyn ® 7930 | 15 | | | 37 |
| Surlyn ® 6320 | 9.6 | | | 35.5 |
| Surlyn ® 9320 | 9.6 | 70 | | |
| AN4318 | 8 | | | 27.5 |
| AN4221C | 12 | 30 | | |
| Magnesium stearate | | 60 | | |
| Magnesium oxide | | 1.12 | | |
| Titanium oxide | | | 2.5 | 2.5 |

Trade names for the materials in the table are indicated below.

AM7318, AM7327: Ionomers available from DuPont-Mitsui Polychemicals Co., Ltd.

Surlyn® 7930, Surlyn® 6320, Surlyn® 9320: Ionomers available from E.I. DuPont de Nemours & Co.

AN4318, AN4221C: Available from DuPont-Mitsui Polychemicals Co., Ltd. under the trademark Nucrel®.

Figure 1B:
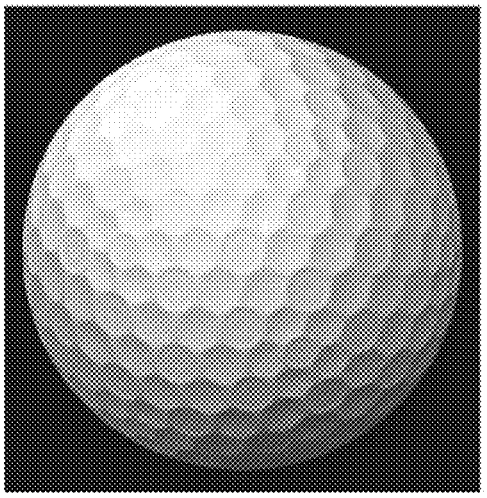
Figure 1C:
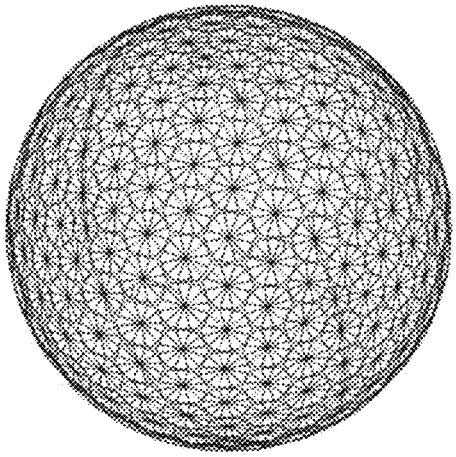

The dimples shown in FIGS. 1A to 1C were formed at this time on the cover surface in each Working Example and Comparative Example. Details on the dimples are shown below in Table 4.

TABLE 4

| | Type A | | | | Type B | | | | Type C | |
|---|---|---|---|---|---|---|---|---|---|---|
| Diagram | FIG. 1A | | | | FIG. 1B | | | | FIG. 1C | |
| Type | No. 1 | No. 2 | No. 3 | No. 4 | No. 1 | No. 2 | No. 3 | No. 4 | No. 1 | No. 2 |
| Shape | circular | | | | circular | | noncircular | | noncircular | |
| Diameter (mm) | 4.3 | 3.8 | 2.5 | 3.8 | 3.5 | 4.5 | | | | |
| Depth (mm) | 0.15 | 0.15 | 0.15 | 0.13 | 0.15 | 0.15 | 0.2 | 0.2 | | |
| Number | 240 | 72 | 12 | 14 | 12 | 98 | 168 | 48 | 12 | 314 |
| Total number of dimples | 338 | | | | 338 | | | | 326 | |
| SR (%) | 81 | | | | 85 | | | | 90 | |
| Low-velocity CL ratio (%) | 81 | | | | 79 | | | | 82 | |
| CD under High-velocity conditions | 0.18 | | | | 0.19 | | | | 0.17 | |

The Type C dimples, as shown in FIG. 1C, are specially shaped dimples surrounded by star-shaped lands. These dimples are made up of a total of 326 dimples consisting of 12 noncircular dimples that are each surrounded and formed by five star-shaped lands and 314 noncircular dimples that are each surrounded and formed by six star-shaped lands. The total number of star-shaped lands is 648. The surface area of the star-shaped lands is from 0.5 to 0.7 $mm^2$ for regions having five star shapes, the average being 0.65 $mm^2$; and is from 0.65 to 1.0 $mm^2$ for regions having six star shapes, the average being 0.9 $mm^2$.

Dimple Definitions

Diameter: Diameter of flat plane circumscribed by edge of dimple.

Depth: Maximum depth of dimple from flat plane circumscribed by edge of dimple.

SR: Sum of individual dimple surface areas, each defined by the flat plane circumscribed by the edge of the dimple, as a percentage of the spherical surface area of the ball were the ball to have no dimples thereon. (units, %)

Aerodynamic Properties (Low-Velocity CL Ratio/High-Velocity CD)

The low-velocity CL ratio was determined by calculating the ratio of the ball coefficient of lift CL at a Reynolds number of 70,000 and a spin rate of 2,000 with respect to the coefficient of lift CL at a Reynolds number of 80,000 and a spin rate of 2,000 rpm from the ball on its trajectory just after it has been launched with an Ultra Ball Launcher (UBL). Similarly, the high-velocity CD was obtained by determining the coefficient of drag when the ball was launched at a Reynolds number of 180,000 and a spin rate of 2,520 rpm.

The UBL is a device manufactured by Automated Design Corporation which includes two pairs of drums, one on top and one on the bottom. The drums are turned by belts across the two top drums and across the two bottom drums. The UBL inserts a golf ball between the turning drums and launches the golf ball under the desired conditions.

Properties such as the core hardness profile, the thickness, material hardness and surface hardness of each layer, and the deflection of various constituent spheres were measured by the methods described below for each of the golf balls obtained. The results are shown in Table 5.

Core Center Hardness (Cc) (JIS-C Hardness)

The core center hardness was obtained by cutting the core in half through the center and measuring the hardness at the center of the resulting cross-section. The JIS-C hardness was measured with the spring-type durometer (JIS-C model) specified in JIS K 6301-1975. The core center hardness was also measured on the Shore D hardness scale with a type D durometer in accordance with ASTM D 2240-95.

Core Surface Hardness (Cs) (JIS-C Hardness)

The core surface hardness was obtained by perpendicularly pressing the indenter of a durometer against the surface of the spherical core and measuring the hardness. The JIS-C hardness was measured with the spring-type durometer (JIS-C model) specified in JIS K 6301-1975. The core surface hardness was also measured on the Shore D hardness scale with a type D durometer in accordance with ASTM D2240-95.

Cross-Sectional Hardnesses (JIS-C Hardnesses) at Specific Positions in Core (1) The cross-sectional hardness at a position 5 mm outside the core center (Cc+5) was obtained by using the spring-type durometer (JIS-C model) specified in JIS K 6301-1975 to measure the hardness at a position 5 mm outside the center in a cross-section of the core obtained by cutting the core in half through the center.

(2) The cross-sectional hardness at a position 5 mm inside the core surface (Cs−5) was obtained by using the above durometer (JIS-C model) to measure the hardness at a position 5 mm inside the surface in a cross-section of the core obtained by cutting the core in half through the center.

Diameter

For the inner core layer, overall core and intermediate layer-encased sphere, the diameters at five random places on the surface were measured at a temperature of 23.9±1° C. and, using the average of these measurements as the measured value for a single inner core layer, overall core or intermediate layer-encased sphere, the average diameter for ten inner core layers, overall cores or intermediate layer-encased spheres was determined. For the ball, the diameters at 15 random dimple-free areas on the surface of a ball were measured and, using the average of these measurements as the measured value for a single ball, the average diameter for ten measured balls was determined.

Deflection

The inner layer core deflection (T), overall core deflection (P), intermediate layer-encased sphere deflection (Q) and ball deflection (R) were each determined by measuring the amount of deflection (mm) when the specimen was compressed at a speed of 50 mm/min under a final load of 1,275 N (130 kgf) from an initial load of 98 N (10 kgf). In each case, the average value for ten measured specimens was determined.

Material Hardnesses of Intermediate Layer and Outer Layer

The intermediate layer and outer layer forming resin materials were molded into sheets having a thickness of 2 mm and left to stand for at least two weeks, following which the Shore D hardnesses were measured in accordance with ASTM D2240-95.

Surface Hardnesses (Shore D Hardnesses) of Core, Various Layer-Encased Spheres and Ball Measurements were taken by pressing the durometer indenter perpendicularly against the surface of the core, various layer-encased spheres or ball (outer layer). The surface hardness of the ball (outer layer) is the measured value obtained at dimple-free places (lands) on the ball surface. The Shore D hardnesses were measured with a type D durometer in accordance with ASTM D2240-95.

Initial Velocities of Inner Core Layer, Overall Core, Intermediate Layer-Encased Sphere and Ball The initial velocities were measured using an initial velocity measuring apparatus of the same type as the USGA drum rotation-type initial velocity instrument approved by the R&A. The inner core layers, overall cores, intermediate layer-encased spheres and balls, collectively referred to below as "spherical test specimens," were held isothermally in a 23.9±1° C. environment for at least 3 hours, and then tested in a room temperature (23.9±2° C.) chamber. Each spherical test specimen was hit using a 250-pound (113.4 kg) head (striking mass) at an impact velocity of 143.8 ft/s (43.83 m/s). One dozen spherical test specimens were each hit four times. The time taken for the test specimen to traverse a distance of 6.28 ft (1.91 m) was measured and used to compute the initial velocity (m/s). This cycle was carried out over a period of about 15 minutes.

TABLE 5

| | | | Working Example | | | | Comparative Example | | | | |
|---|---|---|---|---|---|---|---|---|---|---|---|
| | | | 1 | 2 | 3 | 4 | 1 | 2 | 3 | 4 | 5 |
| | | Dimples | Type C | Type C | Type A | Type B | Type C | Type C | Type C | Type C | Type C |
| | | Construction | 2-layer core 2-layer cover | 2-layer core 2-layer cover | 2-layer core 2-layer cover | 2-layer core 2-layer cover | 2-layer core 2-layer cover | 2-layer core 2-layer cover | 2-layer core 2-layer cover | 1-layer core 2-layer cover | 2-layer core 2-layer cover |
| Core | Inner core layer | Diameter (mm) | 23.0 | 23.0 | 23.0 | 23.0 | 23.0 | 23.0 | 23.0 | — | 23.0 |
| | | Weight (g) | 7.7 | 7.7 | 7.7 | 7.7 | 7.7 | 7.7 | 7.7 | — | 7.7 |
| | | Specific gravity (g/cm$^3$) | 1.21 | 1.20 | 1.20 | 1.21 | 1.22 | 1.20 | 1.19 | — | 1.20 |
| | | Deflection T (mm) | 7.5 | 6.1 | 6.1 | 7.5 | 7.5 | 6.1 | 4.6 | — | 6.1 |
| | | Initial velocity V1 (m/s) | 75.0 | 75.1 | 75.1 | 75.0 | 77.1 | 75.1 | 75.3 | — | 75.1 |
| | Outer core layer | Thickness (mm) | 7.3 | 7.3 | 7.3 | 7.3 | 7.3 | 7.3 | 7.3 | — | 7.3 |
| | | Weight (g) | 25.3 | 25.4 | 25.4 | 25.3 | 25.4 | 25.3 | 25.4 | — | 25.4 |
| | | Specific gravity (g/cm$^3$) | 1.18 | 1.18 | 1.18 | 1.18 | 1.18 | 1.18 | 1.18 | — | 1.18 |
| | Overall core | Diameter (mm) | 37.6 | 37.6 | 37.6 | 37.6 | 37.6 | 37.6 | 37.6 | 37.6 | 37.6 |
| | | Weight (g) | 33.0 | 33.1 | 33.1 | 33.0 | 33.1 | 33.0 | 33.0 | 33.2 | 33.1 |
| | | Deflection P (mm) | 4.8 | 4.2 | 4.2 | 4.8 | 4.8 | 3.0 | 2.6 | 3.7 | 4.2 |
| | | Initial velocity V2 (m/s) | 76.9 | 77.0 | 77.0 | 76.9 | 77.1 | 77.6 | 77.5 | 77.3 | 77.0 |
| | | Core surface hardness Cs (JIS-C) | 84.6 | 84.6 | 84.6 | 84.6 | 83.1 | 93.7 | 93.7 | 77.1 | 84.6 |
| | | Hardness 5 mm inside surface Cs − 5 (JIS-C) | 66.6 | 68.5 | 68.5 | 66.6 | 67.4 | 76.4 | 76.7 | 73.8 | 68.5 |

TABLE 5-continued

| | | Working Example | | | | Comparative Example | | | | |
|---|---|---|---|---|---|---|---|---|---|---|
| | | 1 | 2 | 3 | 4 | 1 | 2 | 3 | 4 | 5 |
| | Hardness at position 5 mm from center Cc + 5 (JIS-C) | 42.9 | 54.1 | 54.1 | 42.9 | 45.0 | 53.5 | 67.1 | 63.7 | 54.1 |
| | Center hardness Cc (JIS-C) | 42.3 | 51.9 | 51.9 | 42.3 | 44.2 | 51.4 | 64.1 | 61.3 | 51.9 |
| | Core surface hardness Cs − Core center hardness Cc (JIS-C) | 42.3 | 32.7 | 32.7 | 42.3 | 38.9 | 42.3 | 29.7 | 15.9 | 32.7 |
| | Core surface hardness Cs − Hardness 5 mm inside surface Cs − 5 (JIS-C) | 18.0 | 16.1 | 16.1 | 18.0 | 15.7 | 17.4 | 17.0 | 3.3 | 16.1 |
| | Hardness at position 5 mm from center Cc + 5 − Center hardness Cc (JIS-C) | 0.6 | 2.2 | 2.2 | 0.6 | 0.8 | 2.1 | 3.1 | 2.4 | 2.2 |
| | {(Cs) − (Cs − 5)}/{Cc + 5} − (Cc)} | 30.0 | 7.3 | 7.3 | 30.0 | 19.5 | 8.2 | 5.5 | 1.4 | 7.3 |
| | Core surface hardness (Shore D) | 56 | 56 | 56 | 56 | 55 | 63 | 63 | 51 | 56 |
| | Core center hardness (Shore D) | 24 | 31 | 31 | 24 | 26 | 31 | 41 | 39 | 31 |
| | Inner core layer deflection T/ Overall core deflection P | 1.55 | 1.45 | 1.45 | 1.55 | 1.55 | 2.01 | 1.72 | — | 1.45 |
| Intermediate layer | Material | No. 1 | No. 1 | No. 1 | No. 1 | No. 1 | No. 1 | No. 1 | No. 1 | No. 1 |
| | Thickness (mm) | 1.32 | 1.32 | 1.32 | 1.32 | 1.31 | 1.32 | 1.31 | 1.32 | 1.32 |
| | Material hardness (Shore D) | 51 | 51 | 51 | 51 | 51 | 51 | 51 | 51 | 51 |
| Intermediate layer-encased sphere | Diameter | 40.22 | 40.23 | 40.23 | 40.22 | 40.22 | 40.25 | 40.24 | 40.23 | 40.23 |
| | Weight (g) | 39.0 | 39.1 | 39.1 | 39.0 | 39.2 | 39.0 | 39.1 | 39.2 | 39.1 |
| | Deflection Q (mm) | 4.1 | 3.8 | 3.8 | 4.1 | 4.1 | 2.7 | 2.4 | 3.5 | 3.8 |
| | Initial velocity V3 (m/s) | 77.2 | 77.1 | 77.1 | 77.2 | 77.3 | 77.6 | 77.5 | 77.3 | 77.1 |
| | Surface hardness (Shore D) | 57 | 57 | 57 | 57 | 57 | 57 | 57 | 57 | 57 |
| Outer layer | Material | No. 2 | No. 2 | No. 2 | No. 2 | No. 2 | No. 2 | No. 2 | No. 2 | No. 3 |
| | Thickness (mm) | 1.24 | 1.23 | 1.23 | 1.24 | 1.24 | 1.23 | 1.23 | 1.24 | 1.23 |
| | Material hardness (Shore D) | 62 | 62 | 62 | 62 | 62 | 62 | 62 | 62 | 50 |
| Ball | Diameter (mm) | 42.7 | 42.7 | 42.7 | 42.7 | 42.7 | 42.7 | 42.7 | 42.7 | 42.7 |
| | Weight (g) | 45.4 | 45.5 | 45.5 | 45.4 | 45.6 | 45.3 | 45.4 | 45.6 | 45.5 |
| | Deflection R (mm) | 3.3 | 3.1 | 3.1 | 3.3 | 3.3 | 2.3 | 2.2 | 3.1 | 3.5 |
| | Initial velocity V4 (m/s) | 77.5 | 77.4 | 77.4 | 77.5 | 77.5 | 77.7 | 77.5 | 77.4 | 76.4 |
| | Surface hardness | 68 | 68 | 68 | 68 | 68 | 68 | 68 | 68 | 56 |
| Dimples | Number | 326 | 326 | 326 | 326 | 326 | 326 | 326 | 326 | 326 |
| Intermediate layer surface hardness − Core surface hardness (Shore D) | | 1 | 1 | 1 | 1 | 2 | −6 | −6 | 6 | 1 |
| Ball surface hardness − Core surface hardness (Shore D) | | 12 | 12 | 12 | 12 | 13 | 5 | 5 | 17 | 0 |
| Ball surface hardness − Intermediate layer surface hardness (Shore D) | | 11 | 11 | 11 | 11 | 11 | 11 | 11 | 11 | −1 |
| Initial velocity of overall core V2 − Initial velocity of inner core layer V1 (m/s) | | 1.9 | 1.9 | 1.9 | 1.9 | 0 | 2.5 | 2.2 | — | 1.9 |
| Initial velocity of intermediate layer-encased sphere V3 − Core initial velocity V2 (m/s) | | 0.3 | 0.1 | 0.1 | 0.3 | 0.1 | 0 | 0 | 0 | 0.1 |
| Ball initial velocity − Intermediate layer-encased sphere initial velocity (m/s) | | 0.3 | 0.3 | 0.3 | 0.3 | 0.3 | 0.1 | 0 | 0.1 | −0.7 |
| Intermediate layer thickness − Cover thickness (mm) | | 0.08 | 0.08 | 0.08 | 0.08 | 0.07 | 0.09 | 0.08 | 0.09 | 0.08 |
| Inner core layer deflection T − Ball deflection R (mm) | | 4.2 | 3.0 | 3.0 | 4.2 | 4.1 | 3.8 | 2.4 | — | 2.6 |
| Oveall core deflection P + Intermediate layer-encased sphere deflection Q + Ball deflection R (mm) | | 12.3 | 11.1 | 11.1 | 12.3 | 12.3 | 8.0 | 7.2 | 10.4 | 11.5 |

In addition, the flight performance (W #1 and I #6) and feel of the golf balls obtained in the respective Working Examples and Comparative Examples were evaluated according to the criteria indicated below. The results are shown in Table 6.

Flight Performance (W #1 Shots)

A driver (W #1) was mounted on a golf swing robot, and the distances traveled by the ball when struck at head speeds (HS) of respectively 35 m/s and 30 m/s were measured and rated according to the criteria shown below. The club was a PHYZ driver (loft angle, 10.5°) manufactured by Bridgestone Sports Co., Ltd. In addition, using an apparatus for measuring the initial conditions, the amount of spin was measured immediately after the ball was similarly struck.

Rating Criteria at Head Speed of 35 m/s:

Good: Total distance was 177.0 m or more

NG: Total distance was less than 177.0 m

Rating Criteria at Head Speed of 30 m/s:

Good: Total distance was 128.0 m or more

NG: Total distance was less than 128.0 m

Flight Performance of Iron (I #6) Shots

A 6-iron (I #6) was mounted on a golf swing robot, and the distance traveled by the ball when struck at a head speed of 34 m/s was measured.

Rating Criteria:

Good: Total distance was 135.0 m or more

NG: Total distance was less than 135.0 m

Feel

Sensory evaluations were carried out when the balls were hit with a driver (W #1) by amateur golfers having head speeds of 25 to 38 m/s. The feel of the ball was rated according to the following criteria.

Rating Criteria:

Good: Six or more out of ten golfers rated the feel as good

NG: Five or fewer out of ten golfers rated the feel as good

Here, a "good feel" refers to a feel at impact that is suitably soft and yet crisp.

TABLE 6

| | | | Working Example | | | | Comparative Example | | | | |
|---|---|---|---|---|---|---|---|---|---|---|---|
| | | | 1 | 2 | 3 | 4 | 1 | 2 | 3 | 4 | 5 |
| Flight | W#1 | Spin rate (rpm) | 2,905 | 3,000 | 3,000 | 2,905 | 2,918 | 3,178 | 3,261 | 3,003 | 3,081 |
| | (HS, 35 m/s) | Total distance (m) | 177.8 | 178.5 | 178.8 | 178.1 | 178.4 | 177.3 | 179.1 | 179.2 | 174.8 |
| | | Rating | good | good | good | good | good | good | good | good | NG |
| | W#1 | Spin rate (rpm) | 2,195 | 2,189 | 2,189 | 2,195 | 2,200 | 2,325 | 2,334 | 2,210 | 2,270 |
| | (HS, 30 m/s) | Total distance (m) | 128.4 | 129.2 | 129.0 | 128.2 | 127.6 | 127.8 | 127.2 | 125.4 | 124.7 |
| | | Rating | good | good | good | good | NG | NG | NG | NG | NG |
| | I#6 | Spin rate (rpm) | 5,469 | 5,571 | 5,571 | 5,469 | 5,498 | 5,933 | 6,300 | 5,733 | 5,995 |
| | (HS 34 m/s) | Total distance (m) | 136.7 | 135.5 | 135.3 | 136.3 | 134.9 | 133.6 | 132.1 | 134.5 | 132.2 |
| | | Rating | good | good | good | good | NG | NG | NG | NG | NG |
| | Feel | Rating | good | good | good | good | good | NG | NG | good | good |

As demonstrated by the results in Table 6, the golf balls of the Comparative Examples were inferior in the following respects to the golf balls according to the invention (Working Examples).

In Comparative Example 1, the value obtained by subtracting the initial velocity of the inner core layer from the initial velocity of the sphere obtained by encasing the inner core layer with the outer core layer was less than 1 m/s, as a result of which the distances traveled by the ball when hit with a driver (W #1) at a head speed of 30 m/s and when hit with a 6-iron (I #6) were inferior.

In Comparative Example 2, the deflection by the manufactured ball under specific loading was lower (indicating greater hardness) than 2.7 mm, as a result of which the spin rate increased, the distances traveled by the ball when hit with a driver (W #1) at a head speed of 30 m/s and when hit with a 6-iron (I #6) were inferior, and the feel at impact was poor.

In Comparative Example 3, the deflection by the manufactured ball under specific loading was lower (indicating greater hardness) than 2.7 mm, as a result of which the spin rate increased, the distances traveled by the ball when hit with a driver (W #1) at a head speed of 30 m/s and when hit with a 6-iron (I #6) were inferior, and the feel at impact was poor.

In Comparative Example 4, the core consisted of a single layer. As a result, the spin rate increased and the distances traveled by the ball when hit with a driver (W #1) at a head speed of 30 m/s and when hit with a 6-iron (I #6) were inferior.

In Comparative Example 5, the material hardness of the hardest layer was softer than 56 and the value obtained by subtracting the core surface hardness from the surface hardness of the intermediate layer, which is the hardest of the cover layers, expressed on the Shore D hardness scale, was less than 2. As a result, the spin rate rose and the initial velocity decreased, leading to an inferior distance under all ball striking conditions.

Japanese Patent Application No. 2017-103700 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a two-layer core consisting of an inner core layer and an outer core layer, and a cover of at least two layers including an intermediate layer and an outer layer having a surface with numerous dimples formed thereon, wherein the cover layer with the greatest hardness of all the cover layers has a material hardness on the Shore D hardness scale of at least 56, the Shore D hardness value obtained by subtracting the surface hardness of the overall core from the surface hardness of the hardest cover layer is at least 2, the ball has a deflection when compressed under a final load of 1,275 N (130 kgf) from an initial load of 98 N (10 kgf) of at least 2.7 mm, and the value obtained by subtracting the initial velocity of the inner core layer from the initial velocity of the sphere consisting of the inner core layer encased by the outer core layer is at least 0.5 m/s, and wherein the overall core has a hardness profile which, letting Cc be the JIS-C hardness at a center of the core and Cs be the JIS-C hardness at the core surface, satisfies the following condition:

$$(Cs)-(Cc)\geq 30, \text{ and}$$

letting V1 be the initial velocity (m/s) of the inner core layer, V2 be the initial velocity (m/s) of the sphere obtained by encasing the inner core layer with the outer core layer, V3 be the initial velocity (m/s) of the sphere obtained by encasing the core with the intermediate layer, and V4 be the initial velocity (m/s) of the ball, the golf ball satisfies the condition:

$$V4>V3\geq V2>V1.$$

2. The golf ball of claim 1, wherein the overall core has a hardness profile which, letting Cc+5 be the JIS-C hardness at a position 5 mm from the core center and Cs−5 be the JIS-C hardness at a position 5 mm inside the core surface, further satisfies the following conditions (1) to (3) below:

$$(Cc+5)-(Cc)\leq 5 \quad (1)$$

$$(Cs)-(Cs-5)\geq 10 \quad (2)$$

$$\{(Cs)-(Cs-5)\}/\{Cc+5\}-(Cc)\}\geq 4. \quad (3)$$

3. The golf ball of claim 1, wherein the inner core layer is formed of a rubber composition that includes two or more types of base rubber and the outer core layer is formed of a rubber composition that includes one or more type of base rubber.

4. The golf ball of claim 1, wherein the intermediate layer is formed primarily of a resin composition comprising:

a base resin of (a) an olefin-unsaturated carboxylic acid random copolymer or a metal ion neutralization product of an olefin-unsaturated carboxylic acid random copolymer or both blended with (b) an olefin-unsaturated carboxylic acid-unsaturated carboxylic acid ester random terpolymer or a metal ion neutralization product of an olefin-unsaturated carboxylic acid-unsaturated carboxylic acid ester random terpolymer or both in a weight ratio therebetween of from 100:0 and 0:100, (c) a fatty acid or fatty acid derivative having a molecular weight of from 228 to 1,500, and (d) a basic inorganic metal compound capable of neutralizing acid groups in the base resin and component (c).

5. The golf ball of claim 1, wherein the material hardness of the cover outer layer is higher than the material hardness of the intermediate layer.

6. The golf ball of claim 1, wherein the number of dimples is from 250 to 370; the dimples are of at least three types; the dimple surface coverage SR, defined as the proportion of the spherical surface of the ball accounted for the dimples, is at least 75%; and the ball when struck has a coefficient of lift CL at a Reynolds number of 70,000 and a spin rate of 2,000 rpm which is at least 70% of the coefficient of lift CL at a Reynolds number of 80,000 and a spin rate of 2,000 rpm.

7. The golf ball of claim 1, wherein the dimples are of non-spherical shape and the ball surface has a land thereon which is surrounded by a plurality of the non-spherical dimples, the land having a shape that includes at least one vertex, being contiguous at substantially a point with each of at least two neighboring lands and having a surface area in the range of from 0.05 to 16.00 $mm^2$.

8. A multi-piece solid golf ball comprising a two-layer core consisting of an inner core layer and an outer core layer, and a cover of at least two layers including an intermediate layer and an outer layer having a surface with numerous dimples formed thereon, wherein the cover layer with the greatest hardness of all the cover layers has a material hardness on the Shore D hardness scale of at least 56, the Shore D hardness value obtained by subtracting the surface hardness of the overall core from the surface hardness of the hardest cover layer is at least 2, the ball has a deflection when compressed under a final load of 1,275 N (130 kgf) from an initial load of 98 N (10 kgf) of at least 2.7 mm, and the value obtained by subtracting the initial velocity of the inner core layer from the initial velocity of the sphere consisting of the inner core layer encased by the outer core layer is at least 0.5 m/s, and wherein the overall core has a hardness profile which, letting Cc be the JIS-C hardness at a center of the core, Cc+5 be the JIS-C hardness at a position 5 mm from the core center, Cs−5 be the JIS-C hardness at a position 5 mm inside the core surface, and Cs be the JIS-C hardness at the core surface, satisfies conditions (1) to (3) below:

$$(Cc+S)-(Cc)\leq 5 \quad (1)$$

$$(Cs)-(Cs-5)\geq 10 \quad (2)$$

$$\{(Cs)-(Cs-5)\}/\{Cc+5\}-(Cc)\}\geq 4. \quad (3)$$

9. The golf ball of claim 8, wherein the inner core layer is formed of a rubber composition that includes two or more types of base rubber and the outer core layer is formed of a rubber composition that includes one or more type of base rubber.

10. The golf ball of claim 8, wherein the intermediate layer is formed primarily of a resin composition comprising:

a base resin of (a) an olefin-unsaturated carboxylic acid random copolymer or a metal ion neutralization product of an olefin-unsaturated carboxylic acid random copolymer or both lended with (b) an olefin-unsaturated carboxylic acid-unsaturated carboxylic acid ester random terpolymer or a metal ion neutralization product of an olefin-unsaturated carboxylic acid-unsaturated carboxylic acid ester random terpolymer or both in a weight ratio therebetween of from 100:0 and 0:100, (c) a fatty acid or fatty acid derivative having a molecular weight of from 228 to 1,500, and (d) a basic inorganic metal compound capable of neutralizing acid groups in the base resin and component (c).

11. The golf ball of claim 8, wherein the material hardness of the cover outer layer is higher than the material hardness of the intermediate layer.

12. The golf ball of claim 8, wherein the number of dimples is from 250 to 370; the dimples are of at least three types; the dimple surface coverage SR, defined as the proportion of the spherical surface of the ball accounted for the dimples, is at least 75%; and the ball when struck has a coefficient of lift CL at a Reynolds number of 70,000 and a spin rate of 2,000 rpm which is at least 70% of the coefficient of lift CL at a Reynolds number of 80,000 and a spin rate of 2,000 rpm.

13. The golf ball of claim 8, wherein the dimples are of non-spherical shape and the ball surface has a land thereon which is surrounded by a plurality of the non-spherical dimples, the land having a shape that includes at least one vertex, being contiguous at substantially a point with each of at least two neighboring lands and having a surface area in the range of from 0.05 to 16.00 $mm^2$.

14. A multi-piece solid golf ball comprising a two-layer core consisting of an inner core layer and an outer core layer, and a cover of at least two layers including an intermediate layer and an outer layer having a surface with numerous dimples formed thereon, wherein the cover layer with the greatest hardness of all the cover layers has a material hardness on the Shore D hardness scale of at least 56, the Shore D hardness value obtained by subtracting the surface hardness of the overall core from the surface hardness of the hardest cover layer is at least 2, the ball has a deflection when compressed under a final load of 1,275 N (130 kgf) from an initial load of 98 N (10 kgf) of at least 2.7 mm, and the value obtained by subtracting the initial velocity of the inner core layer from the initial velocity of the sphere consisting of the inner core layer encased by the outer core layer is at least 0.5 m/s, and wherein the dimples are of non-spherical shape and the ball surface has a land thereon which is surrounded by a plurality of the non-spherical dimples, the land having a shape that includes at least one vertex, being contiguous at substantially a point with each of at least two neighboring lands and having a surface area in the range of from 0.05 to 16.00 $mm^2$.

15. The golf ball of claim 14, wherein the inner core layer is formed of a rubber composition that includes two or more types of base rubber and the outer core layer is formed of a rubber composition that includes one or more type of base rubber.

* * * * *